US006517156B1

(12) United States Patent
Lin

(10) Patent No.: US 6,517,156 B1
(45) Date of Patent: Feb. 11, 2003

(54) BACKREST STRUCTURE FOR A LEISURE CHAIR

(76) Inventor: Chang-Chen Lin, No. 18, Lane 40, Te Yang Load, Yi Lan Hsien (TW)

( * ) Notice: Subject to any disclaimer, the term of this patent is extended or adjusted under 35 U.S.C. 154(b) by 0 days.

(21) Appl. No.: 10/067,650

(22) Filed: Feb. 4, 2002

(51) Int. Cl.[7] ..... A47C 7/46
(52) U.S. Cl. ..... 297/284.4; 297/61
(58) Field of Search ..... 297/284.4, 284.1, 297/61, 354.1, 354.12, 320, 322

(56) References Cited

U.S. PATENT DOCUMENTS 3,929,374 A * 12/1975 Hogan et al. ..... 297/61
3,938,858 A * 2/1976 Drabert et al. ..... 297/284.4
4,040,661 A * 8/1977 Hogan et al. ..... 297/61
4,830,429 A * 5/1989 Petitjean ..... 297/284.4
5,104,189 A * 4/1992 Hanai et al. ..... 297/284.4
5,472,261 A * 12/1995 Oplenskdal et al. ..... 297/284.4

* cited by examiner

*Primary Examiner*—Peter R. Brown
(74) *Attorney, Agent, or Firm*—Charles E. Baxley

(57) ABSTRACT

A chair comprises a base, a backrest, a seat including a rear end pivotally connected to a lower end of the backrest, two armrests securely mounted to the base, each armrest including a front end pivotally connected to the seat and a rear end pivotally connected to the backrest, and a waist rest including a waist rest body, two connecting pieces, and two linkages. The waist rest body includes an arcuate resting portion on an upper end thereof and a lower arcuate resting portion on a lower end thereof. Each connecting piece includes a first peg for pivotal connection with the rear end of an associated armrest. Each connecting piece further includes a second peg for pivotal connection with an end of an associated linkage. The other end of each linkage is pivotally connected to the seat.

2 Claims, 6 Drawing Sheets

BACKREST STRUCTURE FOR A LEISURE CHAIR

BACKGROUND OF THE INVENTION

1. Field of the Invention

The present invention relates to a backrest structure for a leisure chair. In particular, the present invention relates to a chair having a waist rest and a headrest that can be adjusted in the inclination angles thereof to provide increased lying comfort.

2. Description of the Related Art

A typical leisure chair includes a base, two armrests, a seat, and a backrest. The backrest of the leisure chair can be adjusted to a desired inclination angle for the user, providing a comfort lying. A waist rest and a headrest are often attached or provided on a conventional chair. However, the waist rest and the headrest are often fixed and thus could not be adjusted relative to the seat. In a case that the backrest of the chair is adjusted to a substantially horizontal position, the waist rest that provides a support to the user's waist could be an obstacle to the lying comfort. Further, the headrest could not be adjusted in response to the adjustment of the waist rest such that the user might feel uncomfortable, as the head could be located in an excessively inclined position when the user lies down.

SUMMARY OF THE INVENTION

An object of the present invention is to provide a chair having a waist rest and a headrest that can be adjusted in the inclination angles thereof. The lying comfort is improved. In addition, the chair in accordance with the present invention can be detached to reduce the overall size during transport.

A chair in accordance with the present invention comprises a base, a backrest, a seat including a rear end pivotally connected to a lower end of the backrest, two armrests securely mounted to the base, each armrest including a front end pivotally connected to the seat and a rear end pivotally connected to the backrest, and a waist rest including a waist rest body, two connecting pieces, and two linkages. The waist rest body includes an arcuate resting portion on an upper end thereof and a lower arcuate resting portion on a lower end thereof. Each connecting piece includes a first peg for pivotal connection with the rear end of an associated armrest. Each connecting piece further includes a second peg for pivotal connection with an end of an associated linkage. The other end of each linkage is pivotally connected to the seat.

When a user lies down on the backrest, the seat is moved forward while the linkages and the waist rest are pivoted such that the upper arcuate resting portion of the waist rest pivots inward and that the lower arcuate resting portion of the waist rest pivots outward, causing a jointing area between the lower end of the backrest and the seat to protrude more outward to increase the supporting effect and thus provide an increased comfort.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
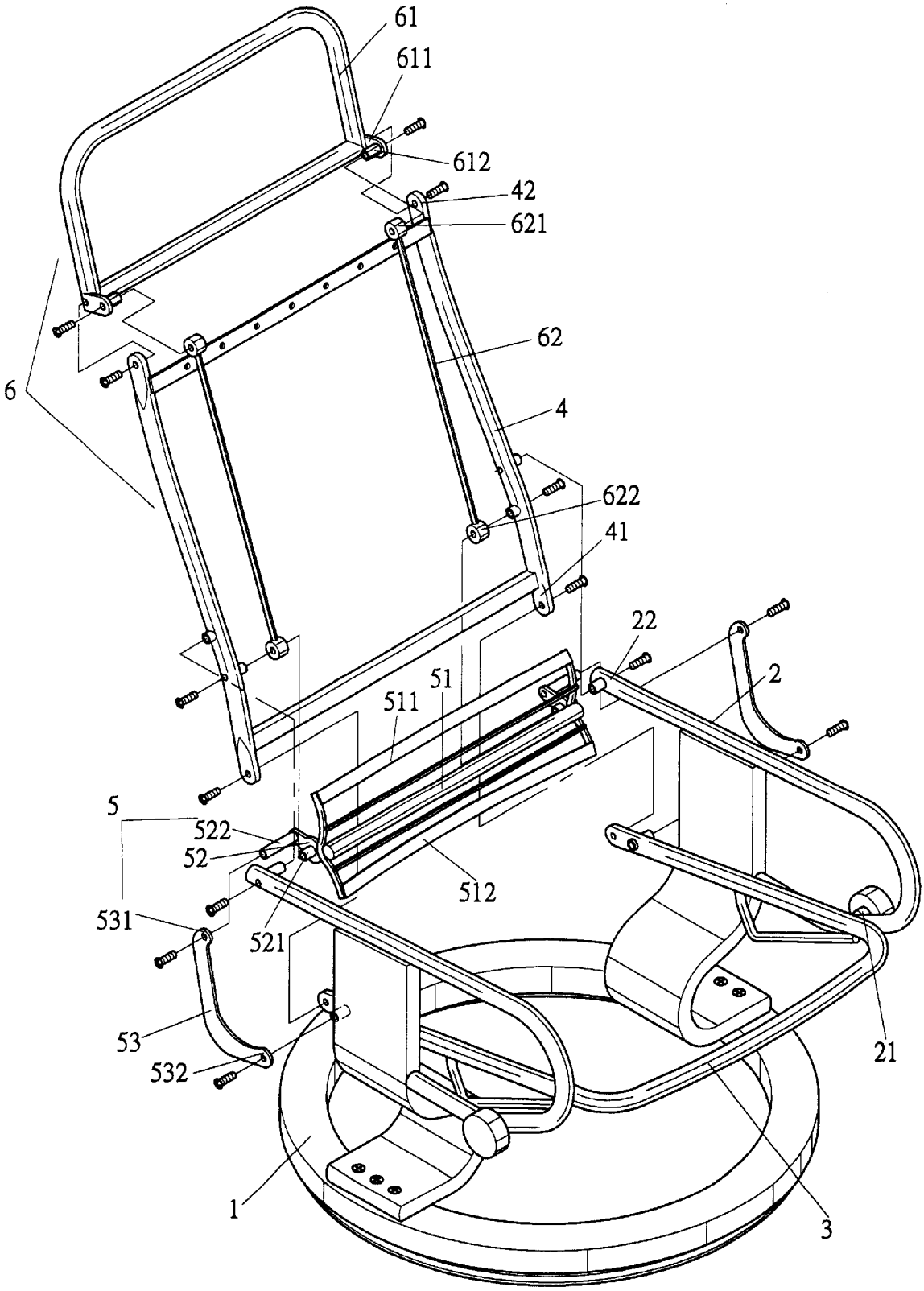
FIG. 1 is an exploded perspective view of a chair in accordance with the present invention.
Figure 2:
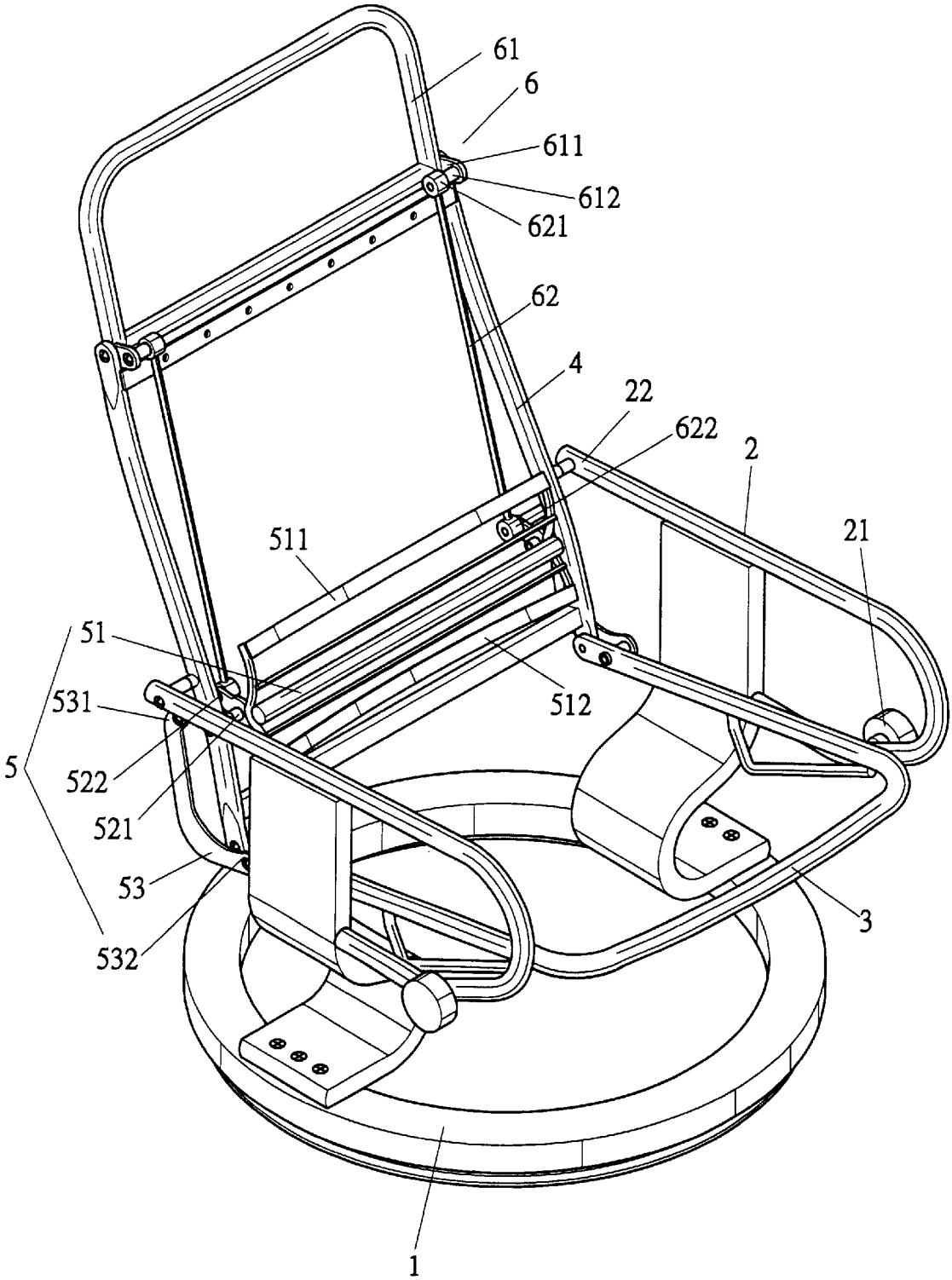
FIG. 2 is a perspective view of the chair in accordance with the present invention.
Figure 3:
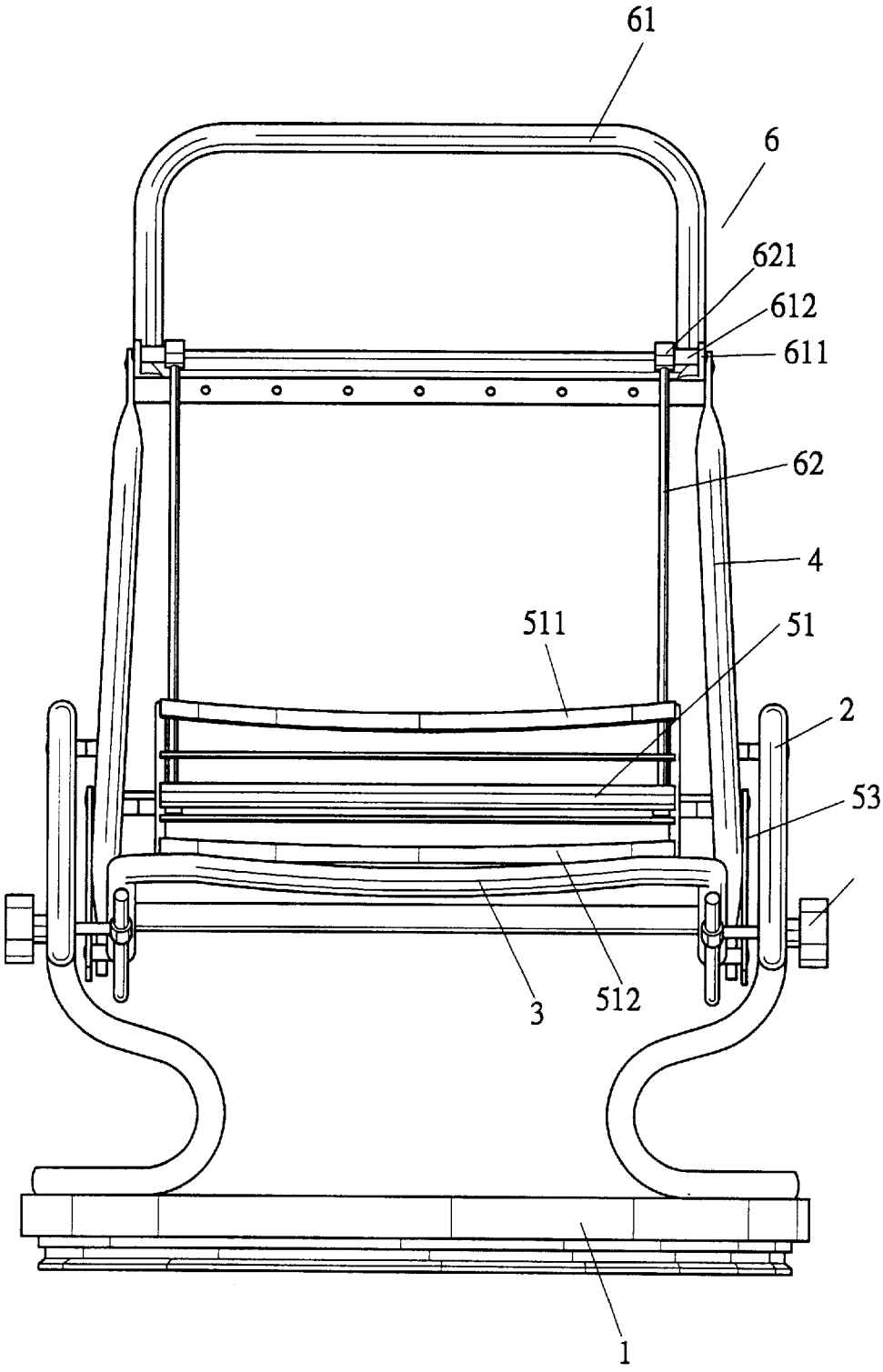
FIG. 3 is a front elevational view of the chair in accordance with the present invention.

Referring to FIGS. 1 through 3, a chair in accordance with the present invention generally comprises a base 1, two armrests 2, a seat 3, a backrest 4, a waist rest 5, and a headrest 6. Each armrest 2 is fixed to the base 1 and includes a front end 21 pivoted to the seat 3 and a rear end 22 pivoted to the backrest 4. The seat 3 has a rear end that is pivotally connected to a lower end of the backrest 4. The backrest 4 can be adjusted to an inclination angle relative to the base 1, and the seat 3 is moved in response to adjustment of the backrest 4. The backrest 4 includes an upper end having pivotal sections 42 for pivotal connection with the headrest 6. The backrest 4 further includes a lower end having pivotal sections 41 for pivotal connection with the waist rest 5.

The waist rest 5 includes a waist rest body 51, two connecting pieces 52 mounted to both sides of the waist rest body 51, and two linkages 53. The waist rest body 51 includes an arcuate resting portion 511 on an upper end thereof and an arcuate resting portion 512 on a lower end thereof, the arcuate resting portions 511 having proper curvatures to provide a comfort support to the user's waist. The connecting pieces 52 are securely attached to both sides of the waist rest body 51 at a proper angle. Each connecting piece 52 includes a first peg 521 for pivotal connection with an associated armrest 2 and a second peg 522 for pivotal connection with a first end 531 of an associated linkage 53. Each linkage 53 includes a second end 532 for pivotal connection with the seat 3.

The headrest 6 includes a headrest body 61 and two connecting rods 62. The headrest body 61 includes two pivotal sections 611 on a lower end thereof for pivotal connection with the backrest 4. Each pivotal section 611 includes a peg 612 for pivotal connection with an end 621 of an associated connection rod 62 in the form of an elongated rod. The other end 622 of each connecting rod 62 is pivoted to the second peg 522 of the associated connecting piece 52 of the waist rest 5.

Figure 4:
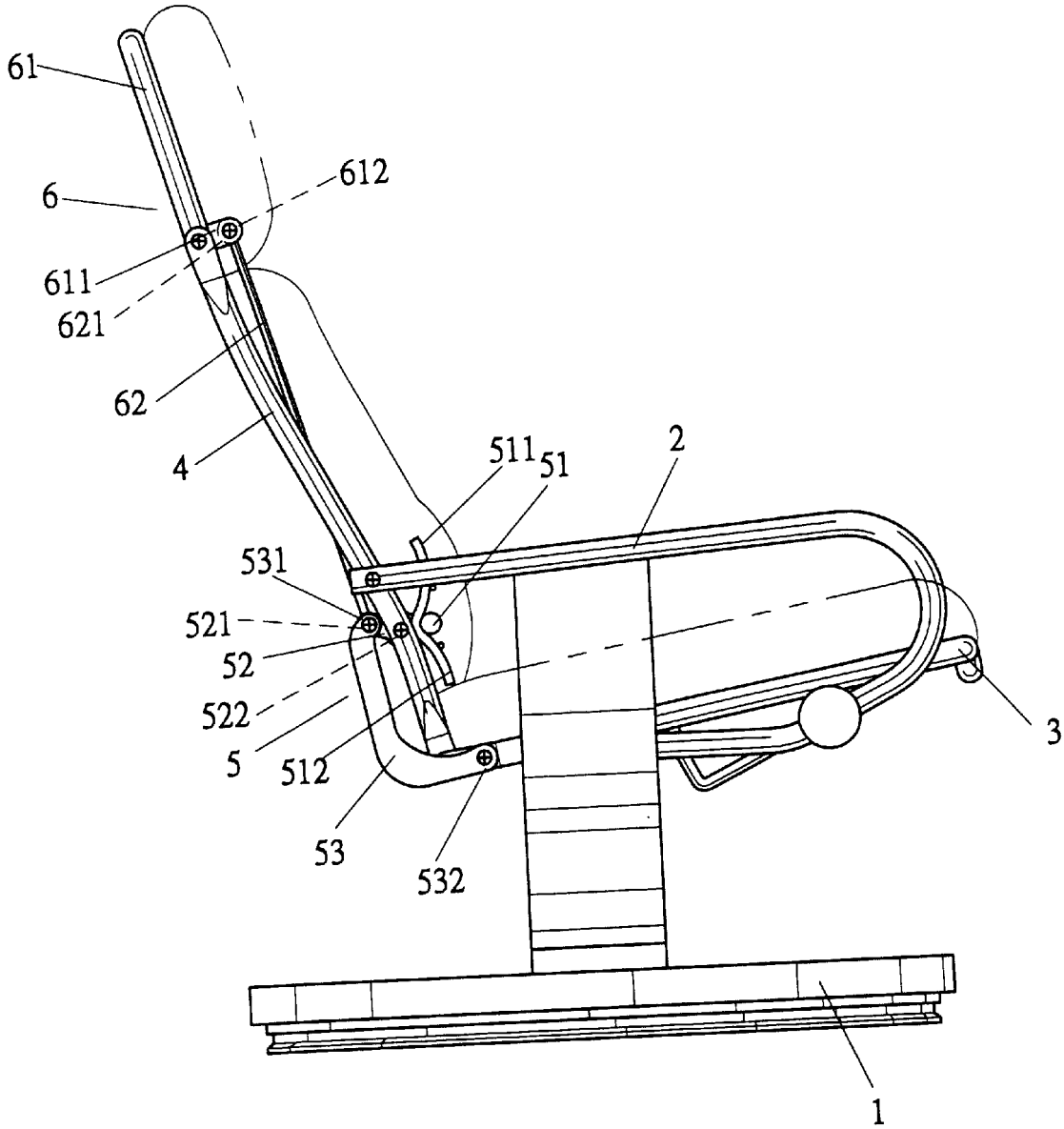
FIG. 4 is a side view of the chair in accordance with the present invention.

When the backrest 4 is in a position shown in FIG. 4, the arcuate resting portion 511 of the waist rest 5 protrudes forwardly to support the user's waist, and the headrest 6 supports the user's head.

Figure 5:
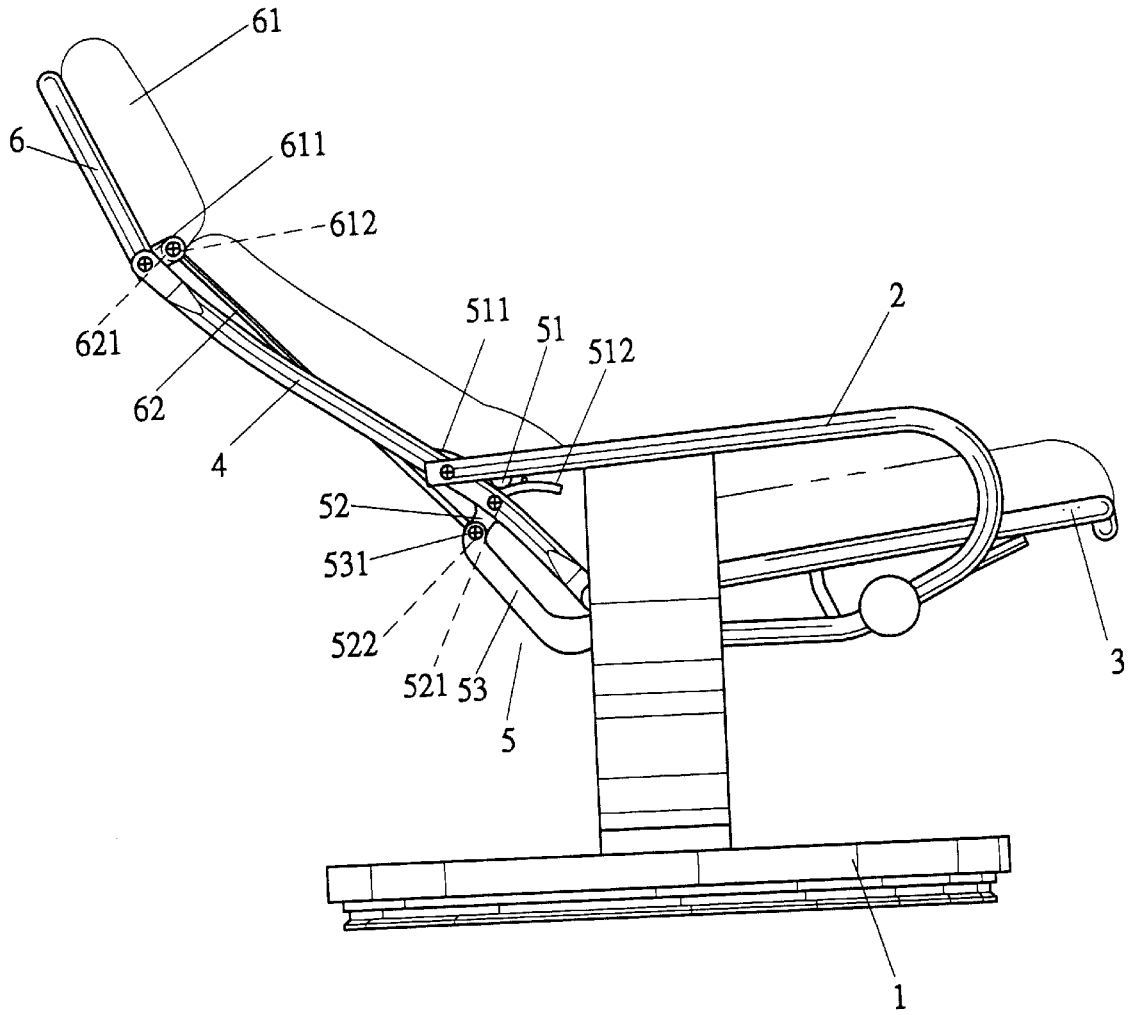
FIG. 5 is a view similar to FIG. 4, illustrating adjustment of the chair.

Referring to FIG. 5, when lying down on the backrest 6, the seat 3 is moved forward. In addition, the linkages 53 and the waist rest 5 are pivoted such that the arcuate resting portion 511 of the waist rest 5 pivots inward and that the arcuate resting portion 512 of the waist rest 5 pivots outward. Thus, the jointing area between the lower end of the backrest 4 and the seat 3 protrudes more outward to increase the supporting effect and thus provide an increased comfort. Further, the headrest 6 moves inward by the connecting rods 62 in response to movement of the linkages 53 and the connecting rods 62. Thus, the headrest 6 provides improved support for the user's head.

Figure 6:
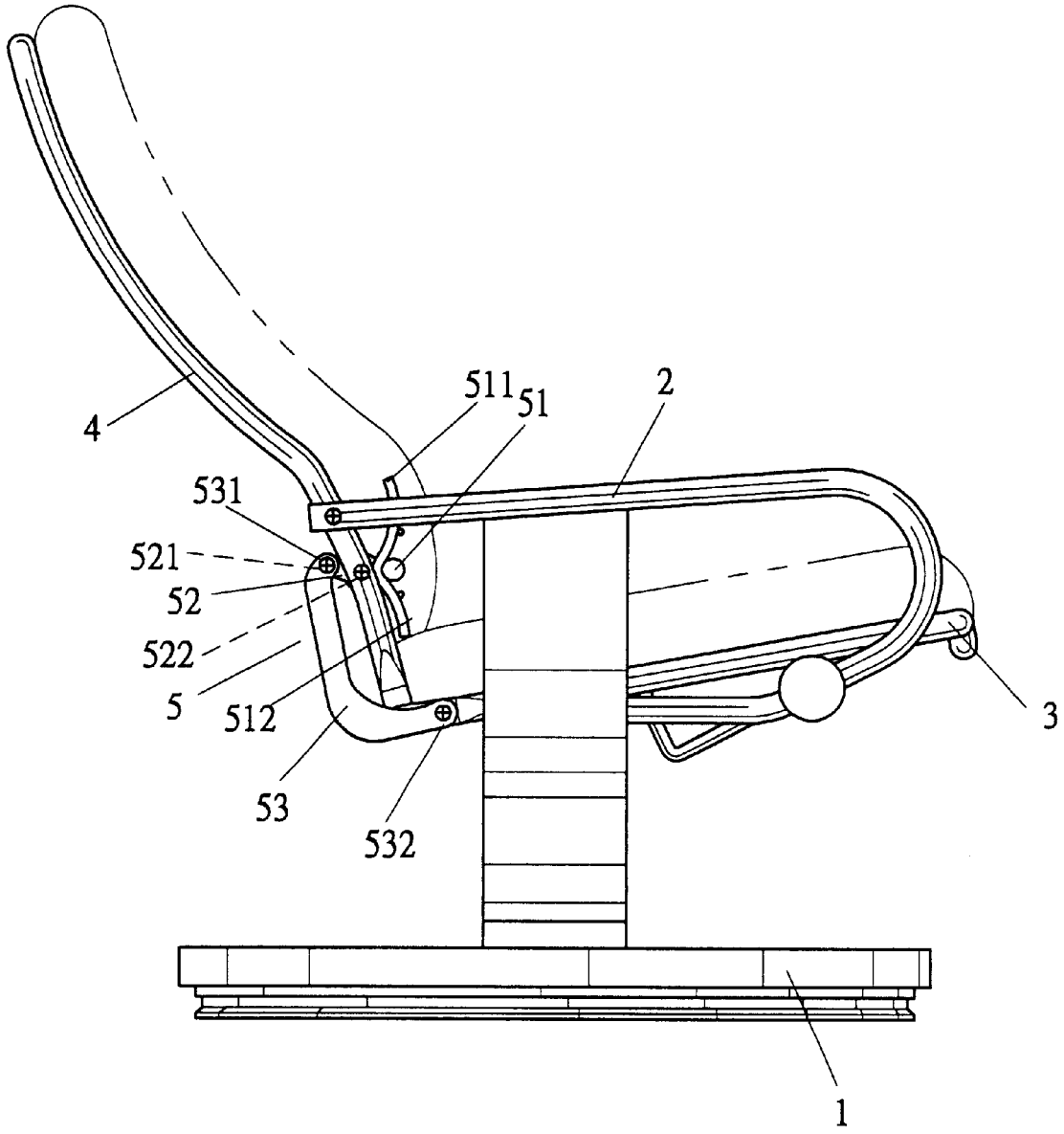
FIG. 6 is a side view of a modified embodiment of the chair in accordance with the present invention.

FIG. 6 illustrates a modified embodiment of the invention, wherein the headrest 6 is omitted. The waist rest 5 provides the same advantages of comfort sitting and lying, as mentioned above.

It is noted that the linkages 53 of the chair in accordance with the present invention can be detached and assembled easily and quickly. Thus, in a factory manufacturing the chairs in accordance with the present invention, the linkages 53 can be detached, and the seat 3 as well as the backrest 4 can be detached to allow overlapping of the seat 3 and the backrest 4. This reduces the overall size of the chair for transport. The transport convenience is increased and the transport cost is reduced.

Although the invention has been explained in relation to its preferred embodiment, it is to be understood that many other possible modifications and variations can be made without departing from the scope of the invention as hereinafter claimed.

What is claimed is:

1. A chair comprising:

a base;

a backrest;

a seat including a rear end pivotally connected to a lower end of said backrest;

two armrests securely mounted to the base, each said armrest including a front end pivotally connected to said seat and a rear end pivotally connected to said backrest; and a waist rest including a waist rest body, two connecting pieces, and two linkages each having a first end and a second end, said waist rest body including an arcuate resting portion on an upper end thereof and a lower arcuate resting portion on a lower end thereof, each said connecting piece including a first peg for pivotal connection with said rear end of an associated one of said armrests, each said connecting piece further including a second peg for pivotal connection with said first end of an associated one of said linkages, said second end of each said linkage being pivotally connected to said seat;

wherein when a user lies down on said backrest, said seat is moved forward while said linkages and said waist rest are pivoted such that said upper arcuate resting portion of said waist rest pivots inward and that said lower arcuate resting portion of said waist rest pivots outward, causing a jointing area between said lower end of said backrest and said seat to protrude more outward to increase the supporting effect and thus provide an increased comfort.

2. The chair as claimed in claim 1, wherein said backrest includes two pivotal sections on an upper end thereof, further comprising a headrest pivotally connected to said pivotal sections of said backrest, said backrest including a headrest body and two connecting rods each having a first end and a second end, said headrest body including a lower end pivotally connected to said pivotal sections of said backrest, each said pivotal section of said backrest including a third peg that is pivotally connected to said first end of an associated one of said connecting rods, said second end of each said connecting rod being pivotally connected to said waist rest, and wherein said headrest moves inward by said connecting rods in response to movement of said linkages and said connecting rods when the user lies down on said backrest.

* * * * *